United States Patent [19]

Bellem

[11] 4,107,892

[45] Aug. 22, 1978

[54] WALL PANEL UNIT

[75] Inventor: Norman A. Bellem, Kansas City, Mo.

[73] Assignee: Butler Manufacturing Company, Kansas City, Mo.

[21] Appl. No.: 819,690

[22] Filed: Jul. 27, 1977

[51] Int. Cl.[2] ..... E04B 1/62; E04B 1/74

[52] U.S. Cl. ..... 52/403; 52/404; 52/589; 52/595; 52/809; 52/802

[58] Field of Search ..... 52/404, 403, 589, 592–595, 52/618

[56] References Cited

U.S. PATENT DOCUMENTS

| | | | |
|---|---|---|---|
| 3,101,820 | 8/1963 | Snyder et al. | 52/593 |
| 3,367,076 | 2/1968 | O'Brien | 52/618 |
| 3,564,800 | 2/1971 | Armitage | 52/593 |
| 3,760,548 | 9/1973 | Sauer et al. | 54/593 |
| 3,998,024 | 12/1976 | Frandsen | 52/403 X |

FOREIGN PATENT DOCUMENTS

| | | | |
|---|---|---|---|
| 2,292,085 | 7/1976 | France | 52/595 |

*Primary Examiner*—J. Karl Bell

*Attorney, Agent, or Firm*—Shoemaker and Mattare, Ltd.

[57] ABSTRACT

A prefabricated wall panel unit capable of being matingly joined with like units in edge-abutting relationship. The unit includes interior and exterior wall panels joined by hermaphroditic coupling elements. The coupling elements each have a channel-defining portion and a wing-defining portion with the portions being offset from each other and positioned so that a wing of one panel unit is received in a channel of an adjacent unit. Deformable strips of low thermal conductivity material are mounted in the channels for embeddingly receiving the wing elements to couple adjacent units together to form a wall.

14 Claims, 4 Drawing Figures

WALL PANEL UNIT

BACKGROUND OF THE INVENTION

The present invention relates in general to prefabricated wall units, and, more particularly, to prefabricated wall units which are coupled together.

Conservation of energy has always been a concern in the building construction industry, and wall units such as that system disclosed in Callahan, U.S. Pat. No. 3,048,244, have been widely used. While systems such as that disclosed in the Callahan, et al. Patent produce relatively good thermal performance, that thermal performance has been found somewhat deficient in light of the new and more demanding energy conservation requirements which are now being used by the building industry.

The thermal performance of the Callahan, et al. system is limited because of the thermal conductance characteristics at the joints used to connect the wall panel units together. Accordingly, if the thermal resistance of the wall panel joints of the current systems, such as that disclosed in the Callahan, et al. Patent, can be improved, such systems can be used in the construction of buildings and still have those buildings meet, or exceed, the new energy conservation requirements used in the building industry.

Some prior art devices have compressible edge seals, but such seals are not true thermal breaks but are for other purposes, such as ease of construction only. Thus, considerable heat loss occurs at panel joints. Other prior art devices merely interpose gaskets and the like to reduce air infiltration, but again, some devices do not have true thermal breaks. In fact, there may even be contact between heat conducting elements in such devices thereby producing a heat path through the panel joint.

In all the prior art devices, the elements used in the panel joint are now proving to be inadequate to properly reduce heat flow through the assembly.

Rather than having elements composed of a single thin member which is not a true thermal break, the device embodying the teachings of the present invention separates the inner and outer panel faces to a considerable distance, thereby producing a true thermal break in the sense that the heat path is interrupted sufficiently to satisfy modern energy requirements.

As used herein, the term thermal break refers to a means which has a low thermal conductivity and thus serves as a heat barrier, or a break, in a heat path which serves to break or block the flow of heat through that heat path. The thermal conductivity of the heat break is thus low with respect to the rest of the heat path. Thus, a true thermal break is sufficiently non-conductive thermally to interrupt heat flow through the path which includes the thermal break and reduce that heat flow to levels acceptable to modern building requirements. It is noted that heat may flow, through nearly any non-theoretical, path, but the true thermal break reduces heat flow be negligible levels, whereas the devices of the prior art, while interrupting heat flow somewhat, are not true thermal breaks as heat flow through the heat path is not reduced to such negligible levels, but is only slightly reduced. Thus, the prior art devices had no true "break" in the heat path, merely a slight barrier. A true thermal break thus serves to (essentially) stop heat flow, as compared to a heat barrier which offers only some impediment thereto.

SUMMARY OF THE INVENTION

The wall panel unit embodying the teachings of the present invention has thermal characteristics which meet and exceed the energy conservation requirements now used in the building industry.

The unit embodying the teachings of the present invention comprises a planar interior wall and a stepped exterior wall coupled together by unit end edge located hermaphroditic coupling elements. Insulation can be located in the unit.

The coupling elements include a channel defined on the marginal edge of one of the wall panels and a wing-defining projection defined on the other of the wall panels. The channel and wing-defining members of each coupling element are offset and spaced apart, and are connected together by a stepped connecting element. Each wall panel unit has a pair of conjugate hermaphroditic coupling elements, that is, one edge element has the channel thereof located adjacent the exterior wall panel and the wing member thereof located adjacent the interior wall panel, while the other coupling element is the reverse thereof so that adjacent wall panel units can be matingly joined with the wing members received in the channel members.

Strips of deformable material, such as impregnated flexible foam, or sealant, or the like, are positioned in the channels, and the wing members are embedded in the material upon coupling adjacent units together. The material has a very low thermal conductivity and serves as a structural tie as well as a thermal break.

As no heat path through the unit is comprised of good thermal conductors arranged in a continuous manner, heat conduction through the unit is low as compared to the units embodying the teachings of the prior art. Stated another way, no thermal short-circuits are present in the joints of the mated panel units embodying the teachings of the present invention. The thermal characteristics of a unit embodying the teachings of the present invention are well within the ranges which are acceptable for present building requirements.

The wing-strip joints enable the units to be securely held together, yet be adjustable during installation to produce a proper, though secure, installation.

The units are symmetrical and therefore common accessories and flashings can be used, thereby preventing any inducement of added construction costs. Furthermore, the units are nestable for easy storage and expeditious shipping.

OBJECTS OF THE INVENTION

It is, therefore, a main object of the present invention to provide a wall panel unit having thermal characteristics which are improved over present units.

It is another object of the present invention to provide joining elements for a wall panel unit which do not have any thermal short circuits.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
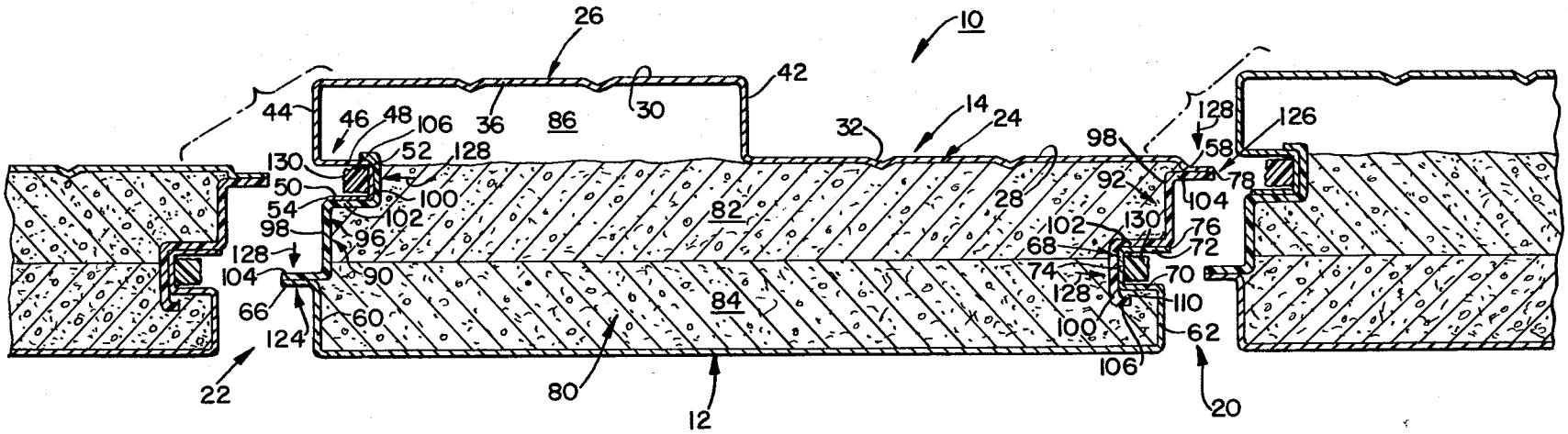
FIG. 1 is a plan view of a wall panel unit embodying the teachings of the present invention.

Shown in FIG. 1 is a self-sustaining panel unit 10 formed of a planar interior wall 12 and a biplanar or stepped exterior wall 14 connected together by hermaphroditic coupling elements 20 and 22 which are located on and form the lateral side edges of the unit 10. The panel units can be used in an interlocking wall system such as that disclosed in Callahan, et al., U.S. Pat. No. 3,048,244, which patent is incorporated herein by reference thereto. The exterior wall 14 has a first planar section 24 and a second planar section 26 projecting outwardly of first section 24, with both sections of the exterior wall 14 having outer surfaces 28 and 30 which each have defined therein longitudinally directed ribs or grooves 32 separated by lands 36. The projecting section 26 has a pair of spaced walls 42 and 44, with wall 42 being located approximately medially of the unit and wall 44 being located to be approximately planar with the end-edge formed by element 22. The wall 44 defines one outer edge of wall 14. Integrally attached to wall 44 is a channel-defining section 46 which is located inward of the wall 14 and has a first channel-defining wall 48 located and directed inwardly of the unit 10 to be approximately co-planar with section 24, and a second channel-defining wall 50 located to be in spaced parallelism with wall 48 and connected thereto by a bight section 52 which defines the channel floor and which is integrally attached to both walls 46 and 50. Wall 50 has a free terminal end edge 54 which is located to be approximately co-planar with section 44, with the channel section 46 being located inwardly of the panel unit 10. A flange section 58 is defined on the other outer edge of wall 14 as an indented section located along the free marginal edge of planar section 24. The function of the flange 58 will be discussed below.

As shown in FIG. 1, interior wall 12 has side edge sections 60 and 62 formed by bent side marginal sections of the wall 12. The marginal sections are bent in a common direction and define portions of the end edges of the panel unit. The section 60 is L-shaped and has the base, or short flange of the L forming a flange-defining section 66 which is bent away from the planar face of wall 12 to be in spaced parallelism therewith. The section 62 has a channel-defining section 68 thereon which includes a pair or spaced channel-defining walls 70 and 72 connected together by a bight section 74 which defines a channel floor with wall 70 integrally attached to section 62, and wall 72 having a free terminal end 76 located to be approximately co-planar with section 62 so that the channel is located inwardly of end edge 20 in the panel unit. As shown in FIG. 1, sections 44 and 60 are approximately co-planar while section 62 is approximately at right angles with flange 58 and is inset from the outer edge 78 thereof.

As shown in FIG. 1, channel 68 is defined to be located near the middle of the thickness of the unit, whereas channel 46 is defined to be located near the exterior wall 14 so that the two channels are spaced from each other with respect to the thickness of the unit 10.

The unit 10 can contain insulation 80 which can be in the form of discrete layers, such as layers 82 and 84, if desired. As shown in FIG. 1, the insulation is positioned between planar section 24 and interior wall 12, thereby defining a void 86 in projecting section 26. The insulation can be of the type disclosed in the Callahan, et al. Patent, or any other suitable insulating material, without departing from the teachings of the present invention. It is here noted that due to the construction of the units embodying the teachings of the present invention, panel strength is independent of the insulation material. Many known panels require special insulation to produce the panel strength, and, thus, this drawback is overcome by the present panel. The coupling devices 20 and 22 therefore play a part in the structural capacity of the panels.

Each of the coupling devices 20 and 22 has a stepped connecting element 90 and 92, respectively, connecting walls 12 and 14 together. The connecting elements 90 and 92 are identical, and each includes a zig-zag shaped central body portion, such as portion 96 of element 90 having offset parallel portions 98 and 100 connected together by connecting portion 102 integrally connected to the centrally-located end edges of the parallel portions. Integrally attached to the free end of portion 98 is a long flange portion 104 and integrally connected to the free end of portion 100 is a short flange portion 106. The two flange portions 104 and 106 are positioned to be in sapced parallelism and are both directed outwardly of the wall unit 10. As shown in FIG. 1, the elements 90 and 92 are identical, but inverted with respect to each other, so that the long flange of element 90 is located adjacent the thickness center of the unit 10 while the short flange of element 92 is located adjacent the thickness center of the unit 10. As will be discussed below, this inverted orientation produces pairs of conjugate coupling devices. The connecting elements 90 and 92 also serve as a thermal break as well as a structural tie and hence should be manufactured of a low thermal conductivity material such as a reinforced thermosetting resin or possibly a thermoplastic material, or like material having a low thermal conductivity.

As seen in FIG. 1, in the element 92 the width dimension of the connecting element portion 100 as measured between short flange 106 and connecting portion 102 thereof exceeds the width of the channel-defining bottom 74 as measured between the channel-defining walls 70 and 72 of the channel 68 so that there is a gap 110 defined between the short flange 106 and the wall 70 of the channel 68. The channel 46 is wider, and thus no gap is defined between the channel 46 and the corresponding leg of flange 90.

The long flange 104 of the connecting element 90 is attached to flange 66 and is coterminal therewith to form an inner wing 124, and the long flange of the connecting element 92 is attached to flange 58 and is coterminal therewith to form an outer wing 126. Self-piercing rivets, metal stitching, or the like, can be used to attach the connecting element to the walls via the flanges, wings and channel. Adhesive bonding between these two elements is also a technical possibility, but metal stitching is a preferred method. The self-piercing rivets or metal stitches are indicated in FIG. 1 by the numeral 128. The channels are attached to the corresponding wall portions of the zig-sag body portion of the connecting elements to thereby attach the inner and outer walls together to thereby form the wall unit 10. Therefore, the wings 124 and 126 form the male elements, and the channels 46 and 68 form the female elements of the hermaphroditic coupling elements 20 and 22.

Material in elongate strips 130 is located in the channels as shown in the figures, and are co-extensive with the wall panel units. Preferably, the material of the strips 130 is gasket or sealant material, such as a flexible foam sealant which is water and vapor tight and which is expandible and is impregnated with sealant. The material can also be caulking, or other similar material. The material has a very low thermal conductivity and, as above discussed, serves as a structural tie as well as a thermal break. The strips 130 are approximately rectangular in transverse cross-section, have adhesive on one side thereof and are attached at that one side to surfaces of the channel bottom defining walls 52 and 74, which surfaces are presented outwardly of the wall panel unit. The other walls of the strips are free of and spaced from the channel walls in the FIG. 1 unmated state of the wall units. The strips 130 are deformable, and mounting the strips 130 as above-discussed enables those strips to expand upon the hereafter-discussed mating of the panel units. The spacing between the channel walls and the strip walls can be selected to provide the proper amount of adhesion in the mating process, as will be discussed below.

Figure 2:
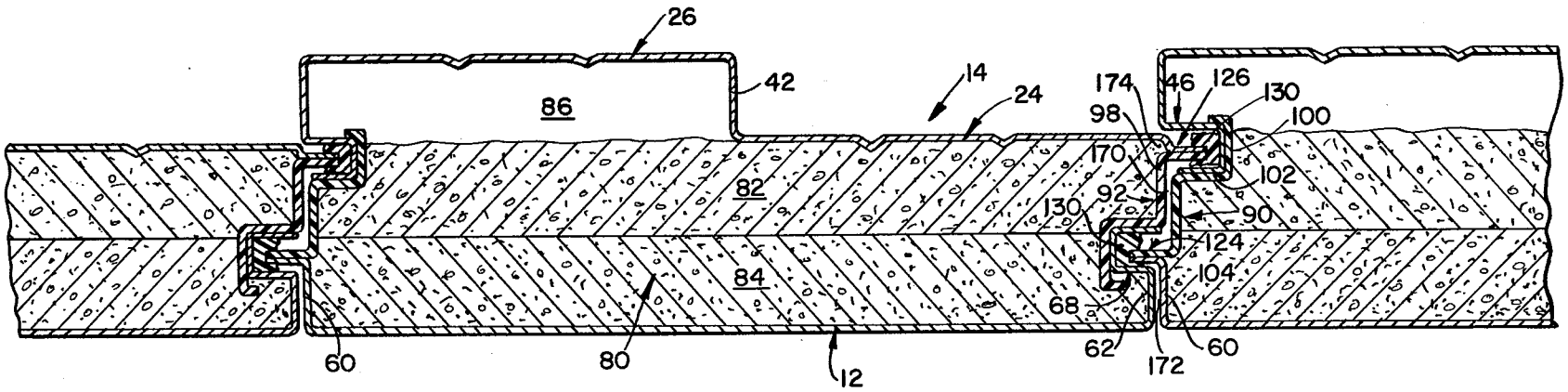
FIG. 2 is a plan view of a wall panel unit matingly engaged in edge abutting relationship with adjacent wall panel units.

The joined, or mated condition of the wall units is shown in FIG. 2. As shown in FIG. 2, in the edge-abutting end-to-end connection of units, the wings 124 and 126 are embedded in the strips 130 which are positioned in a corresponding channel and thus form an air seal. The material in strips 130 deforms or flows within the channel to accommodate the wings and to trap same in the FIG. 2 position. As is evident from FIG. 2, the units are adjustably mated by reason of the wing-receiving material 130. Thus, adjacent units can be moved with respect to each other to account for expansion or contraction and the like, to insure that the inner walls of adjacent units are, and remain, co-planar, or in any other desired relationship.

Once set, the material in strips 130 securely retains the embedded wings in the proper position. The adhesive is interposed between the wings and the channels, thereby breaking any heat path which might exist. Furthermore, the embedded wings prevent heat loss through any gaps remaining between panels after those panels have been joined, such as gaps 170 and 172. However, the gaps can be completely eliminated by simply moving the panels securely together and forcing the wings further into the material of strips 130. In fact, outer wing 126 may even act as a heat shield in the summer months, and inner wing 124 may act as a heat shield in the winter months to prevent energy loss at the panel unit joints. Because of the adhesive, there is no continuous metal heat path defined in the joints, and the thermal barrier produced by the interlocked wall units is not vitiated. Furthermore, the offset nature of the positions of the two wings produces an extension of insulation, identified by the numeral 174 which may extend across gap 170 to further enhance the insulation effect of the joint.

The width of the wings, the depth of the channels, and the amount of material used in the strips 130 are all selected to provide the proper fit while allowing some adjustment of the units with respect to each other. The connectors 90 and 92 are preferably formed of plastic material, but can be of any other material having low thermal conductivity characteristics. A means for securing the units to a building frame is also disclosed in the Callahan, et al. Patent, as well as in the Product Description Brochure Form No. 2401-L/S/W-10-76, published by the Butler Manufacturing Company of Kansas City, Mo.

Figure 3:
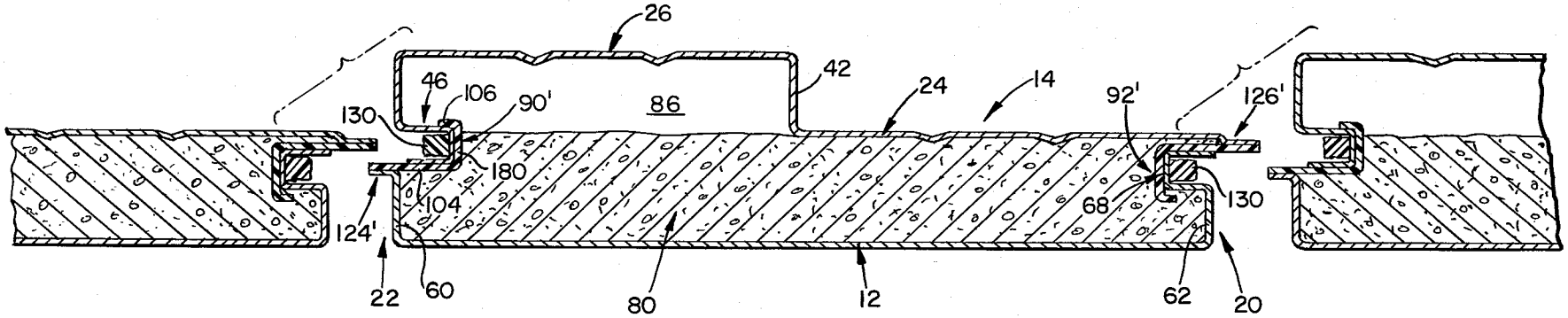
FIG. 3 is a plan view of an alternative form of the wall panel unit embodying the teachings of the present invention.
Figure 4:
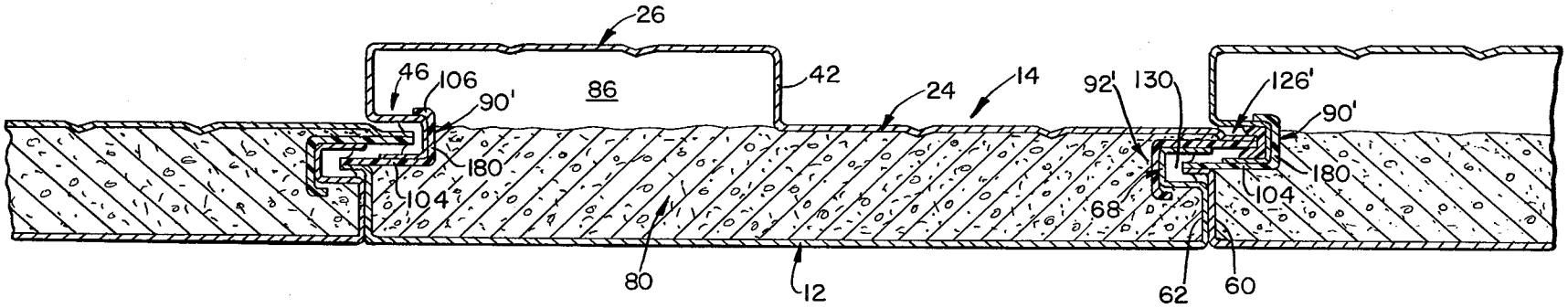
FIG. 4 is a plan view of the alternative form of a wall panel unit matingly engaged in edge abutting relationship with adjacent wall panel units.

An alternative embodiment of the invention is shown in FIGS. 3 and 4 wherein the panel unit has a thickness less than that of the preferred embodiment shown in FIGS. 1 and 2. In the alternative embodiment, the connector elements 90' and 92' are J-shaped and the zig-zag portions are omitted. Thus, the connector elements each have a long flange 104 and a short flange 106 connected together by a bight portion 180. As in the preferred embodiment, the channel-forming members 46 and 68 are secured to the connector members with the connectors and form wings 124' and 126'. The wings 124' and 126' are also embedded into strips 130 in a manner similar to the preferred embodiment with the same result of blocking the heat path between the interior and exterior of the building at the wall unit joints, with the strips thereby producing no metal to metal contact in the heat path. The FIG. 4 embodiment is shown without gaps. It is also noted that corner units, or curved units such as are disclosed in the Callahan, et al. Patent can also employ the wing-strip joint disclosed herein.

It is also noted that the units disclosed herein are easily nestable for shipping, and have been tested for the thermal characteristics thereof. These tests (ASTM C 236) have shown that panel units having plastic connectors, an overall unit thickness of $4\frac{1}{4}$ inches (face separation of 3 inches from the thick section and $1\frac{1}{4}$ inches for the thin portion of the unit) have a U-value of 0.10 to 0.12 BTU/HR/FT$^2$/° F for insulation densities of 0.60 pounds per cubic foot to 1.2 pounds per cubic foot, respectively. These low U-values indicate the nature of the true thermal break provided by the structure embodying the present invention, especially when compared to U-values produced by those devices embodying the teachings of the prior art.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A prefabricated wall panel unit capable of being matingly joined with like units in edge-abutting relationship, comprising:

an elongate interior wall panel having a first wing defining flange on one edge thereof and a first channel defining means on another edge thereof;

an elongate exterior wall panel having a second wing defining flange on one edge thereof and a second channel defining means on another edge thereof;

joining means connecting said wing elements to said channel means, said joining means being formed of a material having a thermal conductivity which is low relative to the material of said panels, said wing and channel elements being positioned on said wall panels so that said first channel means is located at the transverse centerline of the wall panel unit and said second channel means is spaced from the wall panel unit transverse centerline, and said first wing defining flange is located adjacent the wall panel unit transverse centerline and said second wing defining flange is spaced apart from the wall panel unit transverse centerline, said second channel defining means having an outer free edge which is located to be essentially co-planar with said interior wall panel one edge, said exterior wall panel one edge being located outwardly of said interior wall panel channel defining means; and thermal spacer means in each channel defining means for maintaining wing elements of one wall panel unit out of direct thermal contact with channel defining means of an adjoined wall panel unit, said thermal spacer means including deformable strips of low thermal conductivity material mounted in said channels embeddingly receiving said wing-defining flanges and being interposed between adjoined wall panel units, said deformable strips forming a thermal break in a heat path through the wall panel unit whereby direct thermal contact between adjoined wall panel units is prevented so that formation of any continuous heat path between wall panel unit connecting elements is prevented.

2. The unit of claim 1, wherein said exterior wall is stepped.

3. The unit of claim 1, further including insulation positioned between said wall panels.

4. The unit of claim 1, wherein said material is an impregnated flexible foam.

5. The unit of claim 1, wherein said connecting elements each includes a stepped connecting element connecting a wing portion of one wall panel to a channel-defining portion of the other wall panel.

6. The unit of claim 5, wherein said stepped connecting element is formed of non-thermal conducting material.

7. The unit of claim 1, wherein said channels are positioned inwardly of said wing-defining portions with respect to the unit.

8. The unit of claim 5, wherein said stepped connecting element includes a zig-zag central body portion, a short flange integrally attached to one end of said central body portion, and a long flange integrally attached to the other end of said central body portion.

9. The unit of claim 8, wherein said channel-defining portions are each attached to a connecting element at said zig-zag central body portion adjacent said connecting element short flange.

10. The unit of claim 1, wherein said channel-defining portions each have walls and a base and said material strips are left on said bases and have an undeformed width less than that of said channel bases so that said undeformed strips are spaced from said channel walls.

11. The unit of claim 1, wherein said connecting elements each includes a J-shaped connecting element connecting a wing portion of one wall panel to a channel-defining portion of the other wall panel.

12. The unit of claim 11, wherein each J-shaped connecting element is formed of low conductivity plastic material.

13. The prefabricated wall panel unit defined in claim 1, wherein said elongate interior wall panel has a central body portion, a first marginal side edge of said central body bent inwardly of the unit and having an L-shaped flange with the short flange of the L being in spaced parallelism with said central body and directed outwardly thereof, and said channel opens outwardly of the unit; said elongate exterior wall panel has a central body portion with said exterior panel channel opening outwardly of the unit; said joining means including first connecting means attached to said wing forming flange to form a first male element and to connect said interior panel channel to said wing forming flange, and a second connecting means attached to said L-shaped flange short flange to form another wing forming flange element and to connect said exterior panel channel to said short flange.

14. A prefabricated wall comprising:

a plurality of matingly joined units, each unit including an elongate interior wall panel having a first wing defining flange on one edge thereof and a first channel defining means on another edge thereof;

an elongate exterior wall panel having a second wing defining flange on one edge thereof and a second channel defining means on another edge thereof;

joining means connecting said wing elements to said channel means, said joining means being formed of a material having a thermal conductivity which is low relative to the material of said panels, said wing and channel elements being positioned on said wall panels so that said first channel means is located at the transverse centerline of the wall panel unit and said second channel means is spaced from the wall panel unit transverse centerline, and said first wing defining flange is located adjacent the wall panel unit transverse centerline and said second wing defining flange is spaced apart from the wall panel unit transverse centerline, said second channel defining means having an outer free edge which is located to be essentially co-planar with said interior wall panel one edge, said exterior wall panel one edge being located outwardly of said interior wall panel channel defining means; and thermal spacer means in each channel defining means for maintaining wing elements of one wall panel unit out of direct thermal contact with channel defining means of an adjoined wall panel unit, said thermal spacer means including deformable strips of low thermal conductivity material mounted in said channels embeddingly receiving said wing-defining flanges and being interposed between adjoined wall panel units, said deformable strips forming a thermal break in a heat path through the wall panel unit whereby direct thermal contact between adjoined wall panel units is prevented so that formation of any continuous heat path between wall panel unit connecting elements is prevented.

* * * * *